US007070009B2

(12) United States Patent
Kawamoto et al.

(10) Patent No.: US 7,070,009 B2
(45) Date of Patent: Jul. 4, 2006

(54) VIBRATION ISOLATION MOUNT SYSTEM (ISO)

(75) Inventors: Shiro Kawamoto, Gilbert, AZ (US); Andrew Curtis, Texarkana, TX (US); Derek J. Egerstaffer, Nashville, AR (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 0 days.

(21) Appl. No.: 10/872,316

(22) Filed: Jun. 18, 2004

(65) Prior Publication Data

US 2005/0279518 A1 Dec. 22, 2005

(51) Int. Cl.
*B25D 17/11* (2006.01)
*B25D 17/24* (2006.01)

(52) U.S. Cl. ..... 173/211; 173/162.2; 173/162.1; 173/210

(58) Field of Classification Search ..... 173/162.1, 173/162.2, 210, 211; 464/52; 403/225
See application file for complete search history.

(56) References Cited

U.S. PATENT DOCUMENTS 4,236,310 A * 12/1980 Muller ..... 30/276
4,335,585 A * 6/1982 Hoff ..... 464/52
4,491,184 A 1/1985 Kawaharazuka
4,759,128 A 7/1988 Katoh et al.
4,817,738 A 4/1989 Dorner et al.
4,819,742 A 4/1989 Driggers
4,825,548 A 5/1989 Driggers
5,175,932 A 1/1993 Lange et al.
5,345,684 A 9/1994 Shoup et al.
5,375,666 A 12/1994 Pettet et al.
5,692,306 A 12/1997 Stoll et al.
5,774,993 A 7/1998 Schlessmann
5,855,069 A 1/1999 Matsubayashi et al.
6,010,407 A * 1/2000 Ishikawa ..... 464/52
6,213,677 B1 4/2001 Yamane et al.
6,446,421 B1 9/2002 Kramer et al.
6,550,145 B1 4/2003 Stoll et al.
2002/0004988 A1 1/2002 Stoll et al.
2002/0139630 A1 * 10/2002 Shih ..... 192/55.61
2003/0154946 A1 8/2003 Momosaki et al.

FOREIGN PATENT DOCUMENTS

EP 1234491 A1 8/2002

* cited by examiner

*Primary Examiner*—Scott A. Smith
*Assistant Examiner*—Brian Nash
(74) *Attorney, Agent, or Firm*—Pearne & Gordon LLP

(57) ABSTRACT

A power tool includes vibration isolation material positioned between an engine shroud and a drive shaft housing. The vibration isolation material isolates the drive shaft housing from engine vibration for radial, axial, and torsional movement without utilizing intermediate components.

18 Claims, 2 Drawing Sheets

VIBRATION ISOLATION MOUNT SYSTEM (ISO)

FIELD OF THE INVENTION

The present invention relates to power tools and more particularly, to a vibration isolation mount system for a power tool.

BACKGROUND OF THE INVENTION

In work apparatus such as brushcutters, edge cutters or the like, a relatively long drive shaft housing is provided between a drive motor and its housing, on the one hand, and a driven rotatable work tool on the other hand. During operation, vibration problems can result in connection with the interaction between the drive motor and the driven work tool.

Accordingly, the drive shaft housing is typically connected to the motor housing via an anti-vibration system in order to avoid such vibration problems. The anti-vibration system must effectively damp occurring vibration problems and at the same time, provide a reliable connection of the drive shaft housing to the motor housing.

Conventional anti-vibration systems employ a clamp, fixed with clamping lugs, on the motor end of the drive shaft housing. The clamping lugs are typically manufactured from plastic or die cast metal. A tubular-shaped damping element made of elastic material is pushed over the clamp. For assembly, the unit comprising the drive shaft housing with the clamp and the damping element is pressed into a corresponding receptacle of the motor housing. The clamping lugs project at the end face beyond the motor housing which requires a correspondingly large amount of space for accommodating the same. The clamping action between the clamp and the drive shaft housing can deteriorate when the material yields, for example, in the case where the clamp is made of plastic. On the other hand, when the clamp is made of die cast aluminum, the clamp is so stiff that it can only adapt to the drive shaft housing to a limited extent.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, a handheld power tool is provided. The handheld power tool includes a drive shaft housing; a clutch housing having an aperture therein; and vibration isolation material positioned between the drive shaft housing and the clutch housing. The vibration isolation material includes a locator component and a main body portion; wherein, the locator component projects through the aperture in the clutch housing; and wherein, the main body portion is positioned adjacent the drive shaft housing.

In accordance with another aspect of the present invention an assembly method for a handheld power tool is provided. The method includes inserting a drive shaft housing into a main body portion of a vibration isolation material until an end of the drive shaft housing contacts a radially inward facing flange of the vibration isolation material; and inserting the vibration isolation material into a clutch housing.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

DESCRIPTION OF AN EXAMPLE EMBODIMENT

Figure 1:
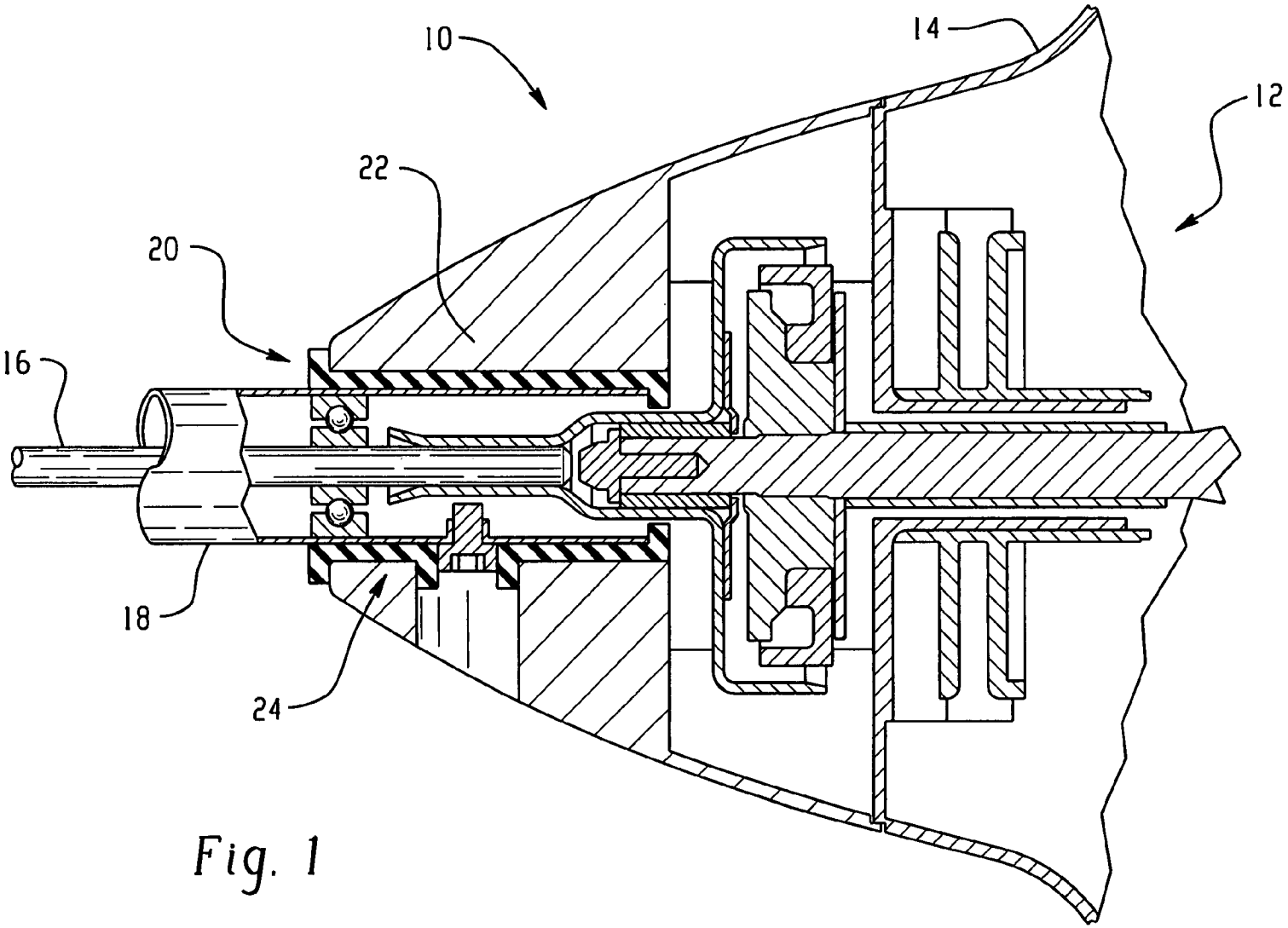
FIG. 1 is a cross sectional view of a hedge trimmer having a vibration isolation mount system in accordance with an aspect of the present invention.

Referring initially to FIG. 1, there is shown a perspective view of an example hedge trimmer 10 incorporating features of the present invention. Although the present invention will be described with reference to the embodiment shown in the drawings and for use in a hedge trimmer, it should be understood that the present invention could be incorporated into any suitable type of power tool or power equipment and is not limited to use merely in a hedge trimmer and, may be incorporated in different types of embodiments. In addition, any suitable size, shape or type of elements or materials could be used.

The hedge trimmer 10 generally comprises a drive motor 12 contained within an engine shroud 14. Only the output shaft of the drive motor 12 is shown. It is to be appreciated that a complete drive motor 12 is provided within a complete hedge trimmer 10. The drive motor 12 can be an internal combustion engine; however, any suitable engine can be provided. A drive shaft 16 extends between the drive motor 12 (i.e., at the output shaft) and a trimmer head (not shown). The drive shaft 16 is rotatably contained within a drive shaft housing 18. In particular, the drive shaft 16 is supported via bearings 40, which guide the drive shaft 16. The bearings 40 (FIG. 2) are arranged within an end portion of the drive shaft housing 18. The drive shaft 16 and drive shaft housing 18 extend into an opening 20 of a clutch housing 22, which is coupled to the engine shroud 14. Within the opening 20, a vibration isolation mount system 24 is provided for supporting the end portion of the drive shaft 16 and drive shaft housing 18 in a vibration-damping manner.

Figure 2:
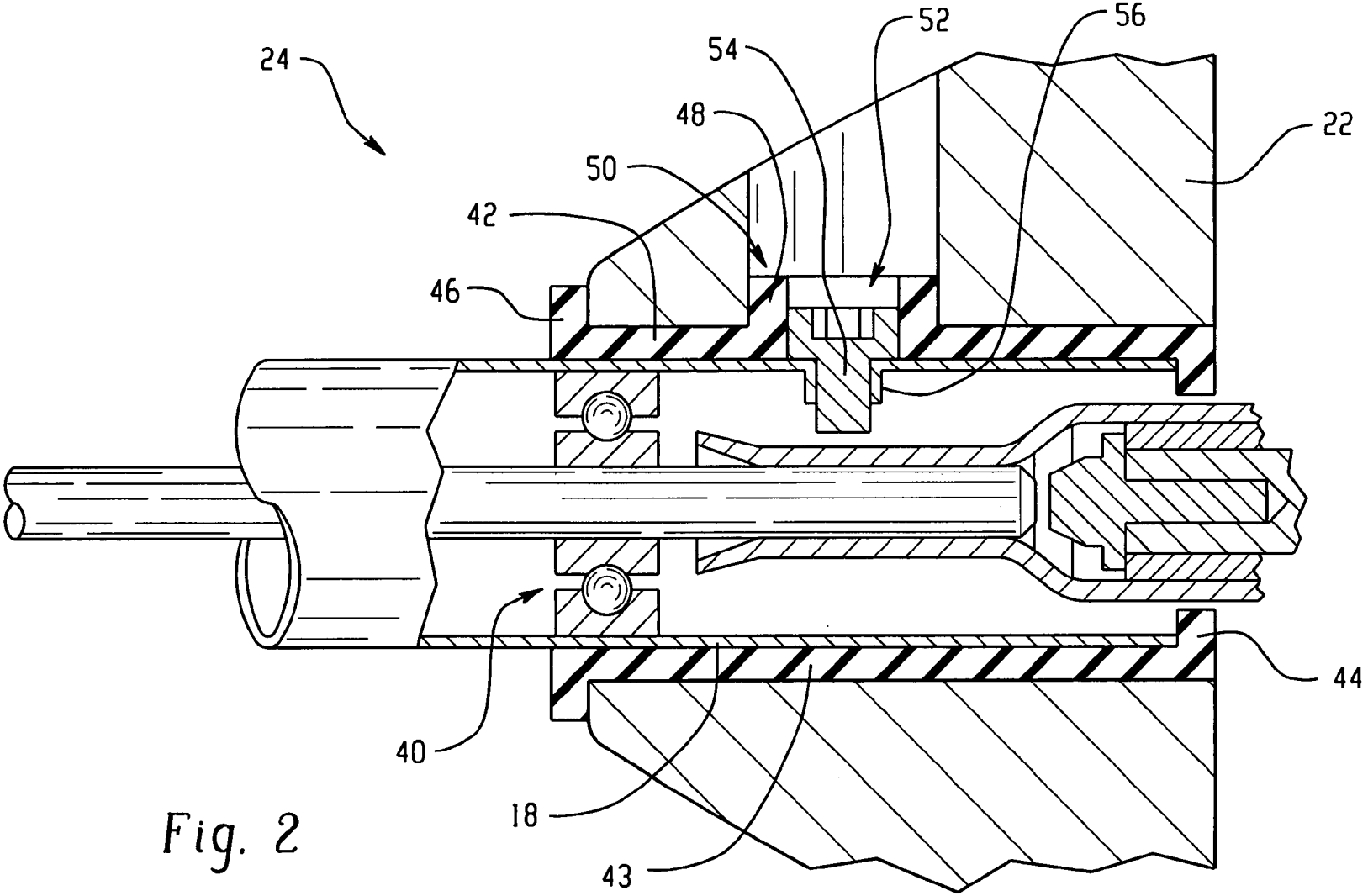
FIG. 2 is an enlarged cross-sectional view of a vibration isolation mount system shown in FIG. 1.

FIG. 2 illustrates the vibration isolation mount system 24 in greater detail. The vibration isolation mount system 24 is positioned between the clutch housing 22 and the drive shaft housing 18 and operates to sufficiently isolate the drive shaft housing 18 from engine vibration that is radially, axially, and torsionally transmitted to the working tool and an operator. The vibration isolation mount system 24 comprises vibration isolation material 42 made of rubber, or the like. It is to be appreciated that any suitable material operable to sufficiently isolate the drive shaft housing 18 from engine vibration can be employed. A main body portion 43 of the vibration isolation material 42 is provided around an outer periphery of an end portion of the drive shaft housing 18, such that the vibration isolation material 42 is adjacent the drive shaft housing 18. Thus, an inner diameter of the main body portion 43 corresponds with an outer diameter of the drive shaft housing 18. An outer diameter of the main body portion 43 corresponds with a diameter of the opening 20 in the clutch housing 22. Thus, the drive shaft housing 18, the vibration isolation material 42, and the clutch housing 22 are coupled together free of intermediate components. Accordingly, fewer elements are needed in the assembly of the vibration isolation mount system 24; thereby facilitating easier assembly and reduction in weight of the vibration isolation mount system 24 and the hedge trimmer 10 overall.

Further, the main body portion 43 of the vibration isolation material 42 includes a first end having a radially inward facing flange 44 and a second end having a radially outward facing flange 46. The radially inward facing flange 44 abuts an end of the drive shaft housing 18; and the radially outward facing flange 46 abuts an end of the clutch housing 22. Thus, the radially inward facing flange 44 can be utilized for positioning of the main body portion 43 with respect to the drive shaft housing 18 during assembly; and the radially outward facing flange 46 can be utilized for positioning of the drive shaft housing 18 and main body portion 43 within the opening 20 of the clutch housing 22 during assembly.

The vibration isolation material 42 also includes a locator component 48 to facilitate positioning of the vibration isolation material 42 with respect to the clutch housing 22. The locator component 48 is materially integral with the main body portion 43 and projects from an outer periphery thereof. The locator component 48 is of a size and shape that corresponds with an aperture 50 provided in the clutch housing 22. For example, the locator component 48 can be a cylindrical structure having an outer diameter that corresponds with an inner diameter of an aperture through a side portion of the clutch housing 22. The locator component 48 can also include an aperture 52 therein that extends through the main body portion 43 of the vibration isolation material 42. The aperture 52 is of a size suitable to receive a fastener 54. A bore (e.g., a threaded bore) 56 is provided in the drive shaft housing 18 at a location that corresponds with the aperture 52 of the locator component 48. The bore 56 of the drive shaft housing 18 can be of the same size or smaller than the aperture 52 in the locator component 48.

To assemble the vibration isolation mount system 24, the drive shaft 16 and drive shaft housing 18 assembly is press fit into the main body portion 43 of the vibration isolation material 42. More specifically, the drive shaft housing 18 is first aligned with the vibration isolation material 42 such that the bore 56 will line up with the locator component 48 when assembled. The drive shaft housing 18 is then inserted into the main body portion 43 until an end of the drive shaft housing 18 contacts the radially inward facing flange 44. Next, the locator component 48 is aligned with the aperture 50 in the clutch housing 22. The drive shaft 16, drive shaft housing 18, and vibration isolation material 42 assembly is then press fit into the clutch housing 22. Specifically, the assembly is inserted into the clutch housing 22 until an end of the clutch housing 22 contacts the radially outward facing flange 46 and the locator component 48 projects into the aperture 50. It is to be appreciated that the locator component 48 can project any distance into the aperture 50, and can even project through the aperture 50. The engagement of the locator component 48 and aperture 50 prevents rotation of the vibration isolation material 42 with respect to the clutch housing 22. The fastener 54 is then inserted through the locator component 48 and engaged with the bore 56 of the drive shaft housing 18 to secure the position of the drive shaft housing 18 with respect to the vibration isolation material 42 and more specifically, to prevent rotation of the drive shaft housing 18 with respect to the vibration isolation material 42. For instance, if the aperture 52 in the locator component 48 is of a substantially similar diameter as the bore 56, a setscrew can be positioned within the aperture 52 and the bore 56. On the other hand, if the aperture 52 in the locator component 48 is of a larger diameter than the bore 56, a fastener such as threaded screw 54, can be utilized such that a head of the fastener is retained within the locator component 48 and a body of the fastener is threadingly, or otherwise, engaged with the bore 56.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A hand held power tool comprising:

a drive shaft housing;

a clutch housing having an aperture therein; and vibration isolation material positioned between the drive shaft housing and the clutch housing, the vibration isolation material comprising a locator component and a main body portion; wherein, the locator component projects into the aperture in the clutch housing; wherein the locator component includes an aperture that extends through the main body portion of the vibration isolation material; and wherein, the main body portion is positioned adjacent the drive shaft housing.

2. The handheld power tool of claim 1, wherein one end of the main body portion includes a radially inward facing flange.

3. The handheld power tool of claim 2, wherein the radially inward facing flange abuts an end of the drive shaft housing.

4. The handheld power tool of claim 1, wherein one end of the main body portion includes a radially outward facing flange.

5. The handheld power tool of claim 4, wherein the radially outward facing flange abuts an end of the clutch housing.

6. The hand held power tool of claim 1, wherein the locator component is a cylindrical structure having an outer diameter that corresponds with an inner diameter of the aperture in the clutch housing.

7. The handheld power tool of claim 1, wherein the locator component aperture is adapted to receive a fastener.

8. The handheld power tool of claim 7, wherein the locator component aperture is aligned with a bore provided in the drive shaft housing so that the fastener can extend through both the locator component aperture and the bore to prevent rotation of the vibration isolation material and the drive shaft housing with respect to each other.

9. The handheld power tool of claim 1, wherein the main body portion is positioned adjacent the clutch housing.

10. An assembly method for a handheld power tool, the method comprising:

providing a drive shaft housing;

providing a clutch housing having an aperture therein;

positioning vibration isolation material between the drive shaft housing and the clutch housing, the vibration isolation material comprising a locator component and a main body portion; and providing the locator component with an aperture that extends through the main body portion of the vibration isolation material; wherein, the locator component projects into the aperture in the clutch housing; and wherein, the main body portion is positioned adjacent the drive shaft housing.

11. The method as set forth in claim 10, wherein the method further comprises providing a radially inward facing flange at one end of the main body portion.

12. The method as set forth in claim 11, wherein the method further comprises abutting the radially inward facing flange to an end of the drive shaft housing.

13. The method as set forth in claim 10, wherein the method further comprises providing a radially outward facing flange at one end of the main body portion.

14. The method as set forth in claim 13, wherein the method further comprises abutting the radially outward facing flange to an end of the clutch housing.

15. The method as set forth in claim 10, wherein the method further comprises providing the locator component as a cylindrical structure having an outer diameter that corresponds with an inner diameter of the aperture in the clutch housing.

16. The method as set forth in claim 10, wherein the locator component aperture is adapted to receive a fastener.

17. The method as set forth in claim 16, wherein the method further comprises aligning the locator component aperture with a bore provided in the drive shaft housing so that the fastener can extend through both the locator component aperture and the bore to prevent rotation of the vibration isolation material and the drive shaft housing with respect to each other.

18. The method as set forth in claim 10, wherein the method further comprises positioning the main body portion adjacent to the clutch housing.

* * * * *